US008238801B2

(12) United States Patent
Miyoshi et al.

(10) Patent No.: US 8,238,801 B2
(45) Date of Patent: Aug. 7, 2012

(54) DEVELOPING DEVICE, PROCESS CARTRIDGE, METHOD AND IMAGE FORMING APPARATUS FOR DEVELOPING AN ELECTROSTATIC LATENT IMAGE ON AN IMAGE CARRIER

(75) Inventors: Yasuo Miyoshi, Kanagawa (JP); Yoshihiro Fujiwara, Kanagawa (JP); Takuya Seshita, Kanagawa (JP); Norio Kudo, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 392 days.

(21) Appl. No.: 12/405,590

(22) Filed: Mar. 17, 2009

(65) Prior Publication Data

US 2009/0238610 A1 Sep. 24, 2009

(30) Foreign Application Priority Data

Mar. 18, 2008 (JP) ..... 2008-068645
Nov. 5, 2008 (JP) ..... 2008-283864

(51) Int. Cl.
*G03G 15/06* (2006.01)
*G03G 15/08* (2006.01)
*G03G 15/09* (2006.01)

(52) U.S. Cl. ..... 399/267; 399/269; 399/272

(58) Field of Classification Search ..... 399/267, 399/269, 272, 277
See application file for complete search history.

(56) References Cited

U.S. PATENT DOCUMENTS 6,070,038 A * 5/2000 Imamura et al. ..... 399/277
6,198,895 B1 * 3/2001 Tsuda et al. ..... 399/267
6,505,014 B2 1/2003 Aoki et al.
6,658,227 B2 12/2003 Oyama et al.
6,671,484 B2 12/2003 Miyoshi et al.
6,704,534 B2 * 3/2004 Hibino ..... 399/277
6,721,516 B2 4/2004 Aoki et al.
7,003,238 B2 2/2006 Yoshida et al.
7,035,575 B2 4/2006 Ikeguchi et al.
7,203,433 B2 4/2007 Kato et al.
7,209,685 B2 4/2007 Oyama et al.
7,280,792 B2 10/2007 Sawai et al.
7,480,475 B2 1/2009 Miyoshi et al.
2006/0210334 A1 9/2006 Tokumasu et al.
2006/0228135 A1 10/2006 Miyoshi
2007/0059047 A1 * 3/2007 Kamiya et al. ..... 399/276
(Continued)

FOREIGN PATENT DOCUMENTS

JP 63092976 A * 4/1988
(Continued)

*Primary Examiner* — David Gray
*Assistant Examiner* — Fred L Braun
(74) *Attorney, Agent, or Firm* — Oblon, Spivak, McClelland, Maier & Neustadt, L.L.P.

(57) ABSTRACT

A developing device, process cartridge method, and image forming apparatus for developing an electrostatic latent image on an image carrier, the developing device including a first carrying member that supplies a developer to a developer carrier at the position of a developer attracting fourth magnetic pole while longitudinally carrying the developer, and a second carrying member that carries the developer released from the developer carrier at the position of a developer releasing third magnetic pole. The developer carrier has two magnetic poles (second and fourth magnetic poles) of the same polarity sandwiching the developer releasing third magnetic pole. Moreover, the developer releasing third magnetic pole is formed by the two magnetic poles (second and fourth magnetic poles) so that the polarity of the developer releasing third magnetic pole differs from the polarity of the two magnetic poles (second and fourth magnetic poles).

13 Claims, 5 Drawing Sheets

U.S. PATENT DOCUMENTS

| | | | |
|---|---|---|---|
| 2007/0134014 | A1 | 6/2007 | Kato et al. |
| 2008/0050137 | A1 | 2/2008 | Miyoshi |
| 2008/0056747 | A1 | 3/2008 | Miyoshi |
| 2008/0145102 | A1 | 6/2008 | Katoh et al. |
| 2008/0145107 | A1 | 6/2008 | Miyoshi |
| 2008/0292338 | A1 | 11/2008 | Fujiwara |

FOREIGN PATENT DOCUMENTS

| | | | | |
|---|---|---|---|---|
| JP | 04240881 | A | * | 8/1992 |
| JP | 06208302 | A | * | 7/1994 |
| JP | 3246986 | | | 11/2001 |
| JP | 2003021952 | A | * | 1/2003 |
| JP | 2003-263012 | | | 9/2003 |
| JP | 3498522 | | | 12/2003 |
| JP | 2003345136 | A | * | 12/2003 |
| JP | 2007155916 | A | * | 6/2007 |
| JP | 2007232774 | A | * | 9/2007 |

* cited by examiner

DEVELOPING DEVICE, PROCESS CARTRIDGE, METHOD AND IMAGE FORMING APPARATUS FOR DEVELOPING AN ELECTROSTATIC LATENT IMAGE ON AN IMAGE CARRIER

CROSS-REFERENCE TO RELATED APPLICATIONS

The present application claims priority to and incorporates by reference the entire contents of Japanese priority document 2008-068645 filed in Japan on Mar. 18, 2008 and Japanese priority document 2008-283864 filed in Japan on Nov. 5, 2008.

BACKGROUND OF THE INVENTION

1. Field of the Invention

The invention relates to an image forming apparatus using an electrophotographic system, and a developing device and a process cartridge for use in the image forming apparatus.

2. Description of the Related Art

Japanese Patent Application Laid-open No. 2003-263012 discloses an image forming apparatus such as a copier and a printer in which at least two carrying members among carrying members forming a developer circulation route in the longitudinal direction are arranged vertically in a developing device. The developer is a two-component developer consisting of a toner and a carrier that may contain additives.

A toner supplying port provided in the developing device using the two-component developer appropriately supplies the toner into the developing device depending on toner consumption in the developing device. The carrying member (a stirring and carrying member) such as a carrying screw stirs and mixes the supplied toner and the developer in the developing device. A part of the stirred and mixed developer is supplied to a developing roller (a developer carrier). A doctor blade (a developer regulating member) regulates the developer carried by the developing roller to an appropriate amount, and then the toner in the two-component developer attaches to a latent image on a photosensitive drum at a position facing the photosensitive drum. A magnet is fixed inside the developing roller, and the magnet forms a plurality of magnetic poles on the circumference of the developing roller.

A first carrying member (a first stirring and carrying member) and a second carrying member (a second stirring and carrying member) are arranged vertically in the developing device in Japanese Patent Application Laid-open No. 2003-263012. These two carrying members form the developer circulation route. The first carrying member arranged at an upper section of the developing device supplies the developer to the developing roller at a position where a developer attracting magnetic pole is located while carrying the developer in the longitudinal direction. The second carrying member arranged at a lower section of the developing device carries the developer released from the developing roller at a position where a developer releasing magnetic pole is located in the longitudinal direction (a direction opposite from the carrying direction of the first carrying member). The downstream side of the developer carrying route of the first carrying member (a first carrying route) connects to the upstream side of the developer carrying route of the second carrying member (a second carrying route) with a first relay unit (a relay unit). The developer reaching to the downstream side of the first carrying route drops on the first relay unit by its own weight and reaches to the upstream side of the second carrying route. The toner supplying port provided in the upstream side of the second carrying route appropriately supplies new toner. The upstream side of the first carrying route connects to the downstream side of the second carrying route with a second relay unit. The developer reaching the downstream side of the second carrying route, which is a mixture of the developer released from the developing roller, the developer dropped from the first relay unit, and the new toner supplied from the upstream side of the second carrying route, stays at the position, is pushed up, and moves to the upstream side of the first carrying route through the second relay unit.

Such a developing device in which the carrying members are vertically arranged is compacter in the horizontal direction compared with a developing device in which the carrying members are horizontally arranged. A developing device in which the carrying members are horizontally arranged is disclosed, for example, in FIG. 8 in Japanese Patent Application Laid-open No. 2003-263012. Therefore, a tandem type image forming apparatus in which a plurality of developing devices is horizontally arranged often uses the developing device in which the carrying members are vertically arranged. A developing device in which the carrying members are vertically arranged and that separates the developer supplying route to the developer carrier (the first carrying route) and the recovering route of the developer being released from the developer carrier (the second carrying route) can make a concentration deviation in the toner image formed on an image carrier because the developer carried on the developing roller and supplied to the developing process does not frequently include developer from after the developing process compared with the developing device in which the carrying members are horizontally arranged.

In the conventional technology disclosed in Japanese Patent Application Laid-open No. 2003-263012 and the like, the developer carried on the developing roller after the developing process is not always released to the second carrying route. Therefore, the developer carried on the developing roller and supplied to the developing process includes the developer from after the developing process, and generates a concentration deviation in the toner image formed on the image carrier.

This has been a non-negligible problem especially when fabricating a smaller-diameter developing roller to downsize the developing device. In a smaller-diameter developing roller, the magnetic poles formed on the developing roller influence each other, and therefore the magnetic flux density of the developer releasing magnetic pole becomes large due to two magnetic poles sandwiching the developer releasing magnetic pole. Therefore, the retention force acting on the developer becomes large at the position of the developer releasing magnetic pole, and the developer carried on the developing roller after the developing process is not released sufficiently.

SUMMARY OF THE INVENTION

It is an object of the present invention to at least partially solve the problems in the conventional technology.

According to an aspect of the present invention, there is provided a developing device that develops an electrostatic latent image on an image carrier by using a developer that contains a carrier and a toner. The developing device includes a developer carrier arranged so as to face the image carrier, a plurality of magnetic poles being formed on circumferential direction of the developer carrier; and a plurality of carrying members that forms a developer circulation route by longitudinally carrying the developer inside a cavity in the developing device. The carrying members include a first carrying member that supplies the developer in the cavity to the developer carrier at a position of a developer attracting magnetic pole among the magnetic poles while longitudinally carrying the developer; and a second carrying member that longitudinally carries a developer released from the developer carrier at a position of a developer releasing magnetic pole among the magnetic poles. The developer carrier is formed such that two magnetic poles sandwiching the developer releasing magnetic pole have same polarity and the developer releasing magnetic pole is formed by the two magnetic poles so that the polarity of the developer releasing magnetic pole differs from the polarity of the two magnetic poles.

According to another aspect of the present invention, there is provided a method of developing to be implemented in a developing device that develops an electrostatic latent image on an image carrier by using a developer that contains a carrier and a toner. The developing device includes a developer carrier arranged so as to face the image carrier, a plurality of magnetic poles being formed on circumferential direction of the developer carrier; and a plurality of carrying members that forms a developer circulation route by longitudinally carrying the developer inside a cavity in the developing device. The carrying members includes a first carrying member that supplies the developer in the cavity to the developer carrier at a position of a developer attracting magnetic pole among the magnetic poles while longitudinally carrying the developer; and a second carrying member that longitudinally carries a developer released from the developer carrier at a position of a developer releasing magnetic pole among the magnetic poles. The method includes forming two magnetic poles sandwiching the developer releasing magnetic pole on the developer carrier such that the two magnetic poles have same polarity; and forming the developer releasing magnetic pole on the developer carrier by the two magnetic poles so that the polarity of the developer releasing magnetic pole differs from the polarity of the two magnetic poles.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. The same reference number is attached to the same or the corresponding part in each drawing, and its repeating description is appropriately simplified or omitted.

In the following explanation, a process cartridge means a unit constructed by integrating at least one of a charging unit that electrically charges an image carrier, a developing unit (the developing device) that develops a latent image formed on the image carrier, and a cleaning unit that cleans toner remaining on the image carrier. The process cartridge is arranged to be freely attachable and detachable to the main body of the image forming apparatus.

Figure 1:
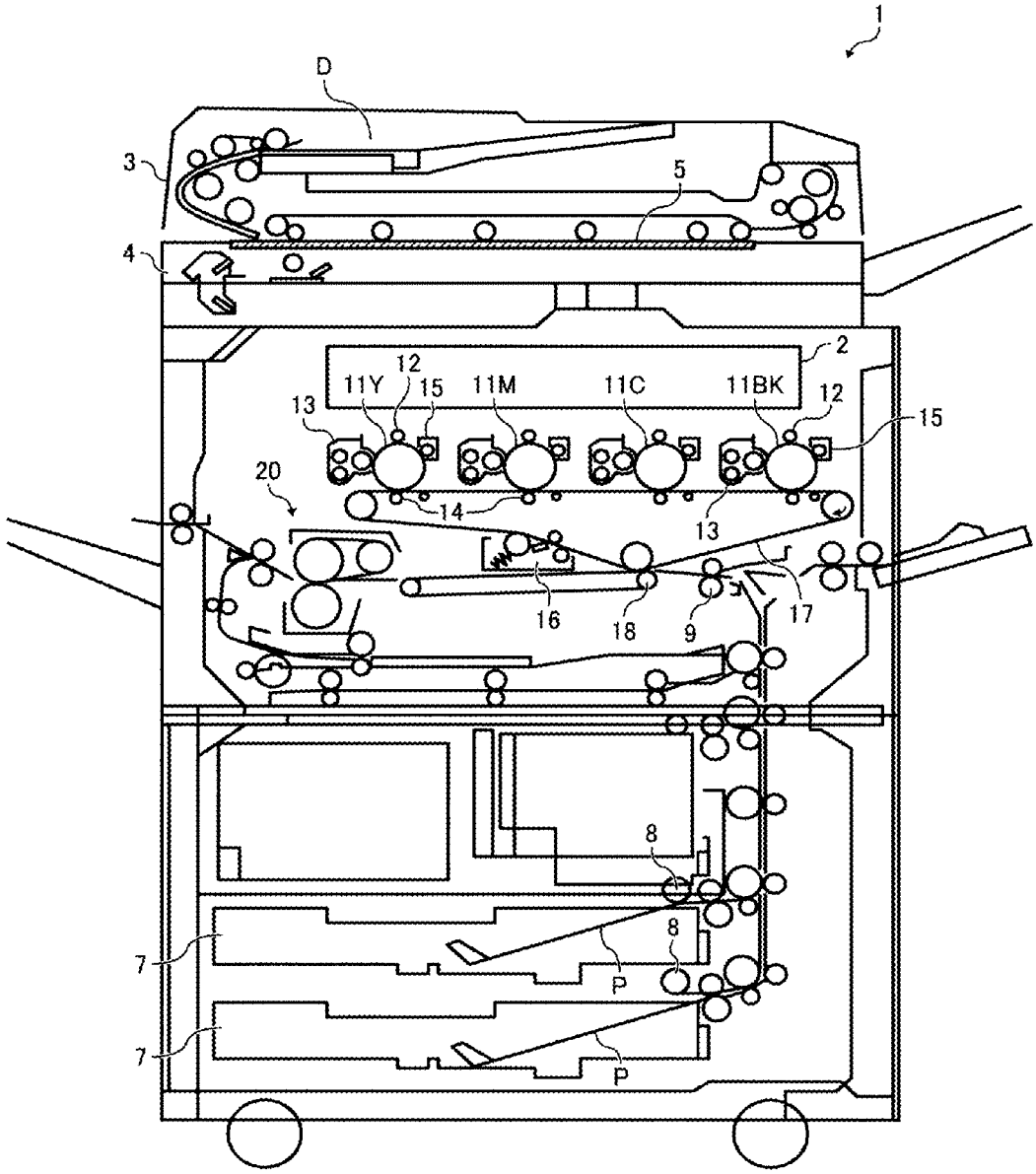
FIG. 1 is a drawing of the entire configuration of an image forming apparatus according to an embodiment of the invention.

First, the configuration and the operation of an image forming apparatus according to an embodiment of the present invention are explained with reference to FIG. 1. As shown in FIG. 1, the image forming apparatus is a tandem-type color copier and includes a main apparatus body 1, a writing unit 2 that emits a laser beam based on input image information, a document conveying unit 3 that conveys a document D to a document reading unit 4, the document reading unit 4 that reads the image information of the document D, a paper supplying unit 7 that stores a recording medium P such as transfer paper, a registration roller 9 that adjusts the conveying timing of the recording medium P, four photosensitive drums 11Y, 11M, 11C, and 11BK as image carriers on which a toner image is formed of each color, yellow, magenta, cyan, and black respectively, four charging units 12 that electrically charge the surfaces of the photosensitive drums 11Y, 11M, 11C, and 11BK, four developing devices 13 that develop electrostatic latent images formed on the photosensitive drums 11Y, 11M, 11C, and 11BK, four transfer bias rollers 14 (a primary transfer bias roller) that transfer by the toner image formed on the photosensitive drums 11Y, 11M, 11C, and 11BK onto the recording medium P in a superimposed manner, and four cleaning units 15 that collect the non-transferred toner remaining on the photosensitive drums 11Y, 11M, 11C, and 11BK.

The image forming apparatus further includes an intermediate transfer belt cleaning unit 16 that cleans toner or dust remaining on an intermediate transfer belt 17, the intermediate transfer belt 17 onto which a toner image of a plurality of colors is transferred in a superimposed manner, a secondary transfer bias roller 18 to transfer the color toner image from the intermediate transfer belt 17 to the recording medium P, and a fixing device 20 that fixes the non-fixed color toner image on the recording medium P.

A toner container (not shown) of each color is arranged at the upper section of each of the photosensitive drums 11Y, 11C, 11M, and 11BK, and supplies a toner (toner particles) of each color (yellow, cyan, magenta, and black) to the developing device 13.

Figure 2:
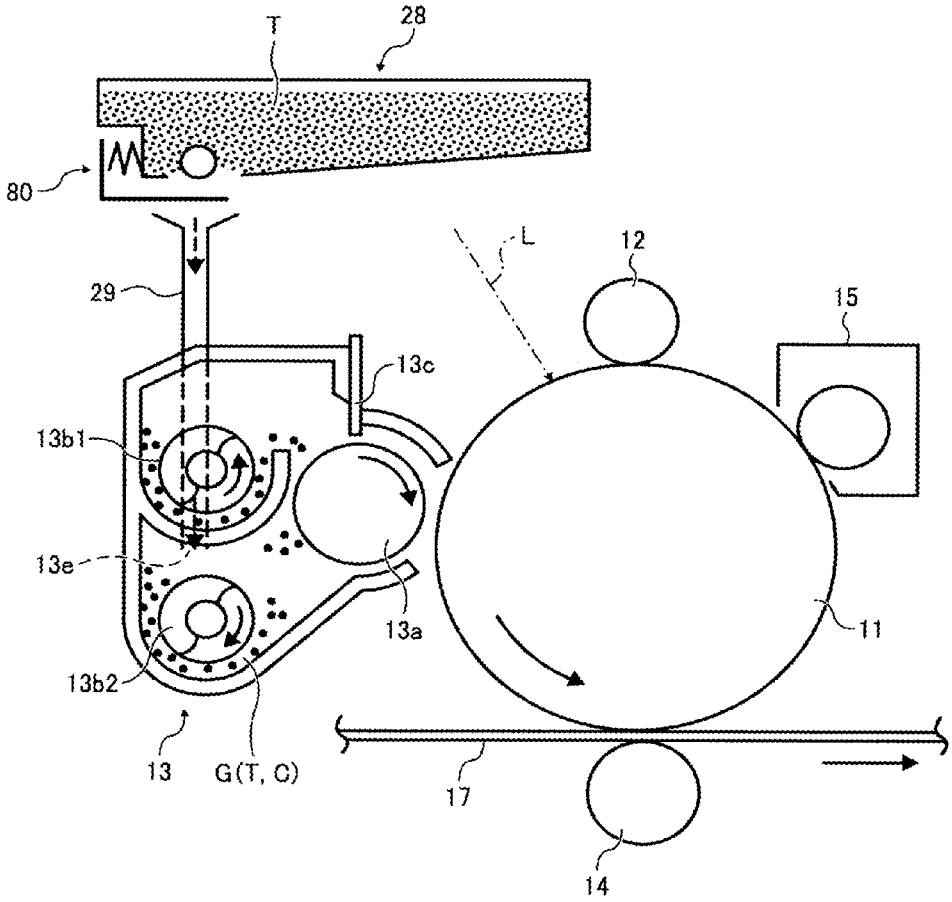
FIG. 2 is an enlarged drawing of a configuration of an image forming unit shown in FIG. 1.

Below, a normal color image forming operation is explained. FIG. 2 can be also referred to for the image forming process performed in the photosensitive drums 11Y, 11M, 11C, and 11BK.

First, a carrying roller in the document conveying unit 3 carries the document D from a document stand in the direction of an arrow in the drawing and places it on a contact glass 5 in the document reading unit 4. Then, the document reading unit 4 reads the image information of the document D placed on the contact glass 5.

In detail, the document reading unit 4 scans an image of the document D on the contact glass 5 while illuminating the document D with a light emitted from an illuminating lamp. Then, the document reading unit 4 forms the image of reflected light from the document D on a color sensor through a mirror group and a lens. The color image information of the document D is converted into an electric image signal after being read in the color sensor at every color separation light of red, green, and blue (RGB). Further, an image processing unit performs a color conversion process, a color correction process, a spatial frequency correction process, and the like on the electric image signal based on the RGB color separation image signal, and obtains color image information of yellow, magenta, cyan, and black.

Then, the color image information of each color of yellow, magenta, cyan, and black is sent to the writing unit 2. The writing unit 2 emits a laser beam L, see FIG. 2, based on the image information of each color to the top of the corresponding photosensitive drums 11Y, 11M, 11C, and 11BK.

Additionally, the photosensitive drums 11Y, 11M, 11C, and 11BK rotate in a clockwise direction in FIG. 1. A portion of the surfaces of the photosensitive drums 11Y, 11M, 11C, and 11BK that comes opposite to the charging unit 12 are uniformly electrically charged by the charging unit 12 (a charging step). As the photosensitive drums 11Y, 11M, 11C, and 11BK rotate, the entire surfaces of the photosensitive drums 11Y, 11M, 11C, and 11BK are uniformly electrically charged. As a result, charging potentials are formed on the surface of the photosensitive drums 11Y, 11M, 11C, and 11BK. After that, the charged surface of the photosensitive drums 11Y, 11M, 11C, and 11BK reaches the respective laser beam radiating position.

In the writing unit 2, four light sources emit respective laser beams that correspond to the image signal of each color in the writing unit 2. Each laser beam propagate through a different optical path at every color component of yellow, magenta, cyan, and black and expose the photosensitive drums 11Y, 11M, 11C, and 11BK (an exposing step).

The laser beam L corresponding to the yellow component is radiated onto the surface of the photosensitive drum 11Y that corresponds to yellow. The laser beam for the yellow component scans the photosensitive drum 11Y in a main scanning direction thereby forming a yellow electrostatic latent image on the photosensitive drum 11Y. A polygon mirror that rotates at a high speed is used to deflect the laser beam for the yellow component so as to scan the photosensitive drum 11Y.

In the same manner, the laser beam corresponding to the magenta component is radiated onto the surface of the photosensitive drum 11M that corresponds to magenta, and a magenta electrostatic latent image is formed on the photosensitive drum 11M. The laser beam corresponding to the cyan component is radiated onto the surface of the photosensitive drum 11C that corresponds to cyan, and a cyan electrostatic latent image is formed on the photosensitive drum 11C. The laser beam corresponding to the black component is radiated onto the surface of the photosensitive drum 11BK that corresponds to black, and a black electrostatic latent image is formed on the photosensitive drum 11BK.

After that, each of the surfaces of the photosensitive drums 11Y, 11M, 11C, and 11BK on which the electrostatic latent image of each color is formed reaches a position facing the developing device 13. Each developing device 13 supplies toner of the respective color onto the photosensitive drums 11Y, 11M, 11C, and 11BK, and the latent image on the photosensitive drums 11Y, 11M, 11C, and 11BK is developed (a developing step).

After that, each of the surfaces of the photosensitive drums 11Y, 11M, 11C, and 11BK reaches a position facing the intermediate transfer belt 17. The transfer bias roller 14 is arranged at each position to be adjacent to the inner peripheral surface of the intermediate transfer belt 17. Then, a toner image of each color formed on the photosensitive drums 11Y, 11M, 11C, and 11BK is successively superimposed on the intermediate transfer belt 17 and transferred on the photosensitive drums 11Y, 11M, 11C, and 11BK at a position of the transfer bias roller 14 thereby forming a multi-color image on the transfer belt 17 (a primary transferring step).

Next, each of the surfaces of the photosensitive drums 11Y, 11M, 11C, and 11BK after the transfer step reaches a position facing the cleaning unit 15. The cleaning unit 15 recovers any non-transferred toner remaining on the photosensitive drums 11Y, 11M, 11C, and 11BK (a cleaning step).

After that, the surfaces of the photosensitive drums 11Y, 11M, 11C, and 11BK pass a charge eliminating unit (not shown), and the sequence of the image forming process at the photosensitive drums 11Y, 11M, 11C, and 11BK is finished.

The intermediate transfer belt 17 with the multi-color image thereon runs clockwise in the drawing, and reaches to a position facing the secondary transfer bias roller 18. Then, the multi-color image is transferred onto the recording medium P at a position facing the secondary transfer bias roller 18 (a secondary transferring step).

After that, the surface of the intermediate transfer belt 17 reaches the position of the intermediate transfer belt cleaning unit 16. Then, the intermediate transfer belt cleaning unit 16 recovers any non-transferred toner attached to the intermediate transfer belt 17, and the sequence of the transfer process at the intermediate transfer belt 17 is finished.

The recording medium P carried between the intermediate transfer belt 17 and the secondary transfer bias roller 18 (a secondary transfer nip roller) is carried from the paper supplying unit 7 via the registration roller 9 and the like.

In detail, the recording medium P is carried from the paper supplying unit 7 that stores the recording medium P by a paper supplying roller 8, it passes a carrying guide, and then it is guided to the registration roller 9. The recording medium P that reaches the registration roller 9 is carried toward the secondary transfer nip roller according to the set timing.

Then, the intermediate transfer belt 17 guides the recording medium P onto which the multi-color image is transferred to the fixing device 20. The multi-color image is fixed onto the recording medium P at a nip of a fixing belt and a pressure roller in the fixing device 20.

Then, the recording medium P with the multi-color fixed thereon is discharged outside of the main apparatus body 1 by a pair of paper discharging rollers, and the sequence of the image forming process is completed.

Next, the image forming unit in the image forming apparatus is described in detail referring to FIGS. 2 to 6.

Figure 3A:
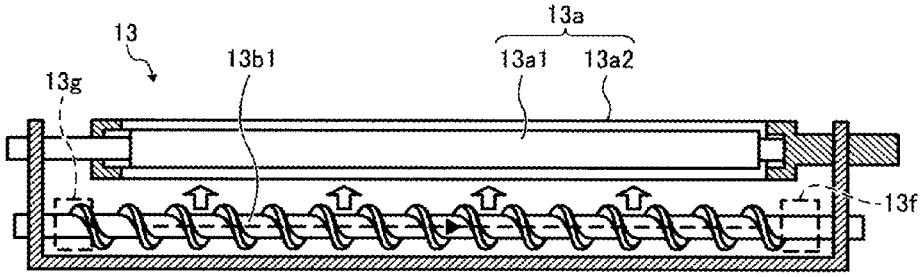
FIG. 3A is a schematic sectional drawing in the longitudinal direction of an upper section of a developing device shown in FIG. 2.
Figure 3B:
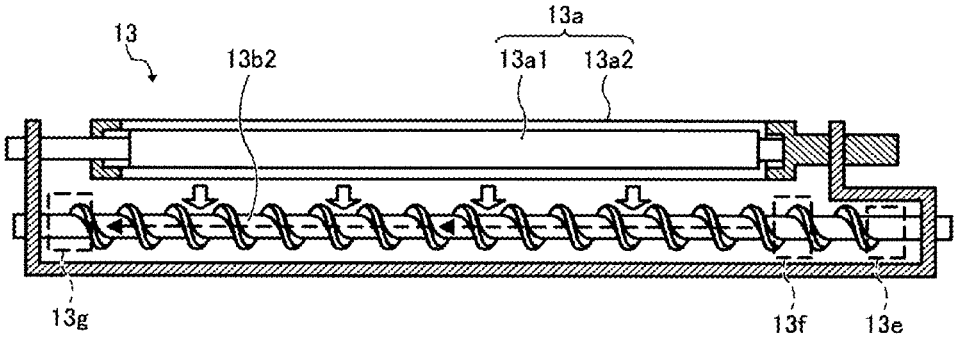
FIG. 3B is a schematic sectional drawing in the longitudinal direction of a lower section of the developing device.
Figure 4:
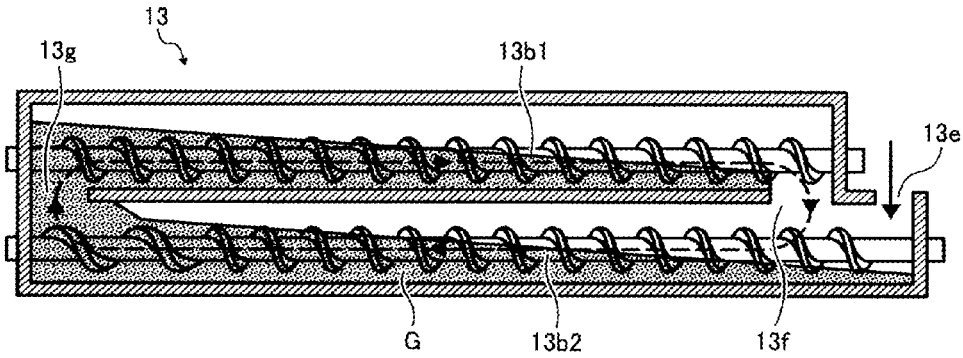
FIG. 4 is a schematic sectional drawing in the longitudinal direction of a developer circulation route in the developing device shown in FIGS. 1 and 2.
Figure 5:
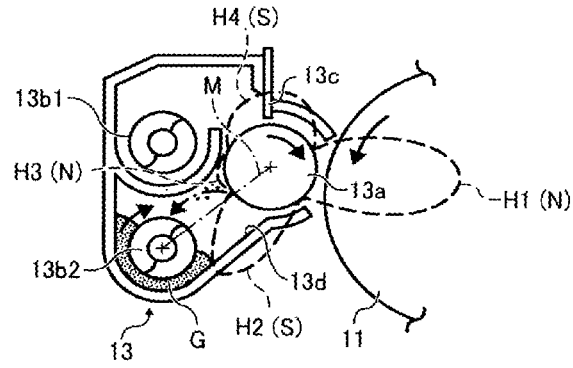
FIG. 5 is a drawing for explaining a magnetic force distribution of magnetic poles formed on a developing roller shown in FIGS. 3A and 3B.
Figure 6:
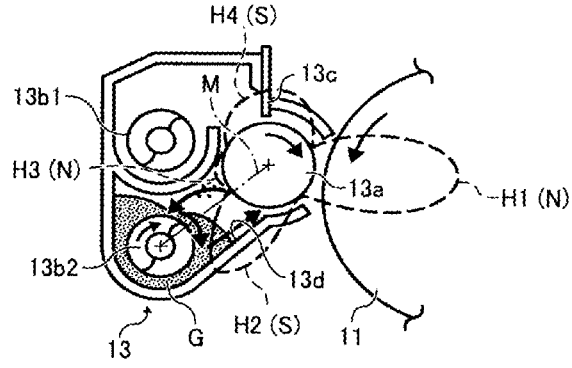
FIG. 6 is a drawing for explaining a flow of a developer at the downstream side of a second carrying route.

FIG. 2 is an enlarged drawing of the configuration of the image forming unit and a toner container 28. FIG. 3A is a schematic sectional drawing in the longitudinal direction (oriented horizontally) of the upper section (the position of a first carrying screw 13*b*1 as the first transfer member) of the developing device 13. FIG. 3B is a schematic sectional drawing in the longitudinal direction of the lower section (the position of a second carrying screw 13*b*2 as the second transfer member) of the developing device 13. FIG. 4 is a schematic sectional drawing in the longitudinal direction (oriented vertically) of a developer circulation route in the developing device 13. FIG. 5 is a drawing for explaining the magnetic force distribution of magnetic poles H1 to H4 formed on a developing roller 13*a* shown in FIGS. 3A and 3B. FIG. 6 is a drawing for explaining a flow of the developer G at the downstream side of a second carrying route.

Because each image forming unit has substantially the same structure, and each toner container has almost the same structure, the image forming units and the toner containers are shown in FIGS. 2 to 6 excluding alphabetic symbols Y, C, M, and BK.

As shown in FIG. 2, the image forming unit is configured with the photosensitive drum 11 as the image carrier, the charging unit 12, the developing device 13 (a developing unit), the cleaning unit 15, and the like.

The photosensitive drum 11 as the image carrier is a negatively charged organic photosensitive having an outer diameter of about 30 millimeters, and is rotationally driven in a counterclockwise direction by a driving mechanism (not shown).

The charging unit 12 includes a charging roller with a foamed urethane layer formed on a metallic cylinder. The foamed urethane layer has elasticity and a moderate resistance, is formed of material that contains urethane resin, carbon black as a conductive particle, a sulfurizing agent, a foaming agent, and the like. The material of the moderate resistance layer of the charging unit 12 that can be used is a rubber material in which a conductive substance such as carbon black and metal oxide is dispersed into urethane, ethylene-propylene-dienepolyethylene (EPDM), butadiene acrylylonitrile rubber (NBR), and isopropylene rubber to adjust the resistance, and a foamed rubber material of these.

The cleaning unit 15 includes a cleaning brush, or a cleaning blade, that is in sliding contact with the photosensitive drum 11. Thus, the cleaning unit 15 mechanically removes and recovers the non-transferred toner on the photosensitive drum 11.

The developing roller 13*a* as the developer carrier is arranged to nearly contact the photosensitive drum 11 in the developing device 13, and a developing region (a developing nip region) is formed where the photosensitive drum 11 contacts to a magnetic brush at the point it faces the developing device 13. The developer G consisting of a toner T and a carrier C is stored in the developing device 13. The developing device 13 develops an electrostatic latent image formed on the photosensitive drum 11 (forming a toner image). The configuration and the operation of the developing device 13 are explained in detail later.

Referring to FIG. 2, the toner container 28 stores therein a toner T, that is to be supplied into the developing device 13. Specifically, a shutter driving unit (not shown) performs opening and closing operation of a shutter mechanism 80 based on the information of the toner concentration, that is a ratio of the toner in the developer G, detected by a magnetic sensor (not shown) arranged in the developing device 13. Thus, an appropriate amount of the toner T is supplied to the developing device 13 from the toner container 28.

The toner T may be supplied based on the information of the image concentration detected from reflectance and the like of the toner image formed on the photosensitive drum 11, the intermediate transfer belt 17, and the like without being limited to the information of the toner concentration. Alternatively, supply of the toner T may be regulated based on a combination of information from these different sources.

A supplying tube 29 guides with certainty the toner T from the toner container 28 into the developing device 13. That is, the toner T discharged from the toner container 28 is supplied into the developing device 13 from a toner supplying port 13*e* through the supplying tube 29.

Referring to FIGS. 2 to 6, the developing device 13 includes the developing roller 13*a* as the developer carrier, the first and the second carrying screws 13*b*1 and 13*b*2 (auger screws) as carrying members, a doctor blade 13*c* as the developer regulating member, and the like.

The outer diameter of the developing roller 13*a* is about 18 millimeters, and it is configured so that a sleeve 13*a*2, made of a non-magnetic body such as aluminum, steel, stainless steel, and a conductive resin into a cylindrical shape, rotates in a clockwise direction in FIG. 2 by a driving mechanism (not shown). Referring to FIGS. 3A, 3B, 4, and 5, a magnetic cylindrical core 13*a*1 forming a plurality of magnetic poles H1 to H4 on the peripheral surface of the sleeve 13*a*2 is arranged coaxially inside the sleeve 13*a*2. The developer G carried on the developing roller 13*a* is carried along with the rotation of the developing roller 13*a* in the direction of the arrow, and reaches the position of the doctor blade 13*c*. The developer G on the developing roller 13*a* is regulated to an appropriate amount with the doctor blade 13*c*, and then the developing roller 13*a* carries the developer G to the position facing the photosensitive drum 11 in the developing region. The toner is attracted toward the electrostatic latent image formed on the photosensitive drum 11 by an electric field formed in the developing region (a developing electric field).

Magnetic poles H1 to H4 formed around the developing roller 13*a* (the sleeve 13*a*2) by the magnetic cylindrical core 13*a*1 are shown in FIG. 5. As shown in FIG. 5, these magnetic poles include a main magnetic pole H1 formed at the position facing the photosensitive drum 11, a carrying magnetic pole H2 that is at the downstream side of the main magnetic pole H1 and formed at a position in a part of an inner wall surface 13*d* of the second carrying route, a developer releasing magnetic pole H3 formed at the upper section of the second carrying route, and a developer attracting magnetic pole H4 (a doctor counter magnetic pole) formed from a position facing the first carrying screw 13*b*1 to near a position facing the doctor blade 13*c*.

First, the developer attracting magnetic pole H4 acts on a carrier as a magnetic body, and the developer G stored in the first carrying route is pumped up to the developing roller 13*a*. A part of the developer G carried on the developing roller 13*a* is scraped off at the position of the doctor blade 13*c* and returned to the first carrying route. On the other hand, the developer G carried on the developing roller 13*a* passing the doctor gap of the doctor blade 13*c*, with the developing roller 13*a* at the position of the doctor blade 13*c* where the magnetic force by the developer attracting magnetic pole H4 acts, naps at the position of the main magnetic pole H1, becomes a magnetic brush in the developing region, and is brought into a sliding contact with the photosensitive drum 11. In such way, the toner T in the developer G carried in the developing roller 13*a* attaches to the latent image on the photosensitive drum. After that, the developer G that passed the position of the main magnetic pole H1 is carried to the position of the developer releasing magnetic pole H3 by the carrying magnetic pole H2. Then, a repulsing magnetic field acts on the carrier at the position of the developer releasing magnetic pole H3, and the developer G, after the developing process has been carried out on the developing roller 13*a*, is released from the developing roller 13*a*. The developer G after being released falls down into the second carrying route and is carried downstream of the second carrying route by the second carrying screw 13*b*2.

The two carrying screws 13b1 and 13b2 (carrying members) stir and mix while longitudinally circulating the developer G stored in the developing device 13.

The first carrying screw 13b1 as the first carrying member is arranged at a position facing the developing roller 13a. The first carrying screw 13b1 horizontally carries the developer G into the longitudinal direction (the rotational axis direction) (to the right, as shown by an arrowed dashed line in FIG. 3A), and supplies the developer G onto the developing roller 13a at the position of the developer attracting magnetic pole H4 (in the direction of white arrows in FIG. 3A).

The second carrying screw 13b2 as the second carrying member is arranged at the lower section of the first carrying screw 13b1 and at a position facing the developing roller 13a. The second carrying screw 13b2 horizontally carries the developer G released from the developing roller 13a (the developer G forcibly released from the top of the developing roller 13a by the developer releasing magnetic pole H3 after the developing process, and some of which is released to the direction of a white arrow in FIG. 3B) in the longitudinal direction (to the left, as shown by an arrowed broken line in FIG. 3B). In the present embodiment, the rotational direction of the second carrying screw 13b2 is set to be the same direction as the rotational direction of the developing roller 13a (a clockwise direction in FIG. 2).

The second carrying screw 13b2 carries the developer G circulated from the downstream side of the carrying route by the first carrying screw 13b1 through a first relay unit 13f as the relay unit to the upstream side of the carrying route by the first carrying screw 13b1 through a second relay unit 13g (in the direction of the arrow in the long and short dashed line in FIG. 3B).

The two carrying screws 13b1 and 13b2 are arranged so that the rotational axes become almost horizontally the same as the developing roller 13a and the photosensitive drum 11. The first and the second carrying screws 13b1 and 13b2 are formed by helically winding a screw unit onto a shaft.

The developer carrying route of the first carrying screw 13b1 (the first carrying route) and the developer carrying route of the second carrying screw 13b2 (the second carrying route) are isolated by a wall member.

Referring to FIGS. 3A, 3B, and 4, the downstream side of the developer carrying route of the second carrying screw 13b2 (the second carrying route) and the upstream side of the developer carrying route of the first carrying screw 13b1 (the first carrying route) communicates with each other through the second relay unit 13g. The developer G that remains and arises near the second relay unit 13g in the developer carrying route of the second carrying screw 13b2 is carried (supplied) to the upstream side of the developer carrying route of the first carrying screw 13b1 through the second relay unit 13g.

Referring to FIGS. 3 and 4, the downstream side of the carrying route by the first carrying screw 13b1 and the upstream side of the developer carrying route of the second carrying screw 13b2 communicate with each other through the first relay unit 13f (the relay unit). The developer G that is not supplied to the top of the developing roller 13a by the first carrying route by the first carrying screw 13b1 falls down by its own weight at the first relay unit 13f, and reaches the upstream side of the second carrying route.

With such configuration, the two carrying screws 13b1 and 13b2 form a circulation route that longitudinally circulates the developer G in the developing device 13. That is, when the developing device 13 is operated, the developer G inside the developing device 13 flows in the direction of the arrow of the dashed lines in FIGS. 3A, 3B, and 4. The concentration deviation of the toner image formed on the photosensitive drum 11 can be made small by separating the developer supplying route G to the developing roller 13a (the first carrying route of the first carrying screw 13b1) and the recovery route of the developer G released from the developing roller 13a (the second carrying route of the second carrying screw 13b2).

The magnetic sensor, which detects the toner concentration of the developer circulating in the developing device 13, is arranged in the developer carrying route of the second carrying screw 13b2. New toner T is supplied to the developing device 13 from the toner container 28 through the toner supplying port 13e arranged near the first relay unit 13f based on the information detected by the magnetic sensor.

Referring to FIGS. 3A, 3B, and 4, the toner supplying port 13e is arranged in the upper section of the upstream side of the developer carrying route of the second carrying screw 13b2, at a position separated from the developing region (outside of the range of the longitudinal direction of the developing roller 13a). By arranging the toner supplying port 13e near the first relay unit, the developer released from the developing roller 13a falls down from the upper section of the supplying toner that has low specific gravity, and the supplying toner can be sufficiently dispersed and mixed into the developer toward the downstream side of the second carrying route over a relatively long time.

The toner supplying port 13e is arranged in the developer carrying route of the second carrying screw 13b2, however, the position of the toner supplying port 13e is not limited to this. For example, the toner supplying port 13e can be arranged in the upper section of the upstream side of the first carrying route.

Below, a typical configuration and operation in the developing device 13 are explained.

Figure 7:
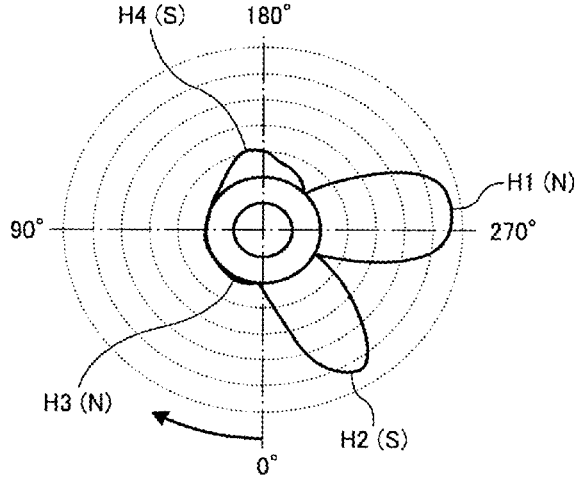
FIG. 7 is a polar graph of a magnetic flux density in the normal direction formed on the developing roller.

As illustrated in FIGS. 5 to 7, four magnetic poles (the main magnetic pole H1, the carrying magnetic pole H2, the developer releasing magnetic pole H3, and the developer attracting magnetic pole H4) are formed around the developing roller 13a (the sleeve 13a2) due to the presence of the magnetic cylindrical core 13a1. In the present embodiment, the developer releasing magnetic pole H3 is formed by magnetic poles H2 and H4 so that polarity of the developer releasing magnetic pole H3 (N-pole) differs from the two magnetic poles H2 and H4, which have the same polarity (S-pole) and sandwich the developer releasing magnetic pole H3. The developer releasing magnetic pole H3 forms a magnetic flux density vector in reverse to the two magnetic poles H2 and H4 along the outer peripheral surface of the developing roller 13a. Therefore, the developer releasing magnetic pole H3 has a very small magnetic flux density in the direction that is normal to the surface of the developing roller 13a (hereinafter, "normal direction to the developing roller 13a"), and is formed in a relatively wide area on the developing roller 13a.

With such configuration, the attraction power (the maintaining power) of the developer G to the developing roller 13a after the developing process is carried out on the developing roller 13a is decreased at the position of the developer releasing magnetic pole H3, and the developer G is certainly released from the developing roller 13a. That is, developer releasability of the developing roller 13a at the position of the developer releasing magnetic pole H3 improves.

The magnetic flux density of the developer releasing magnetic pole H3 in the normal direction to the developing roller 13a is preferably equal to or less than 5 milliteslas to ensure the above-described effect. The magnetic power distributions of the carrying magnetic pole H2 and the developer attracting magnetic pole H4 are set so that the magnetic flux density of the developer releasing magnetic pole H3 becomes equal to or less than 5 milliteslas.

Figure 8:
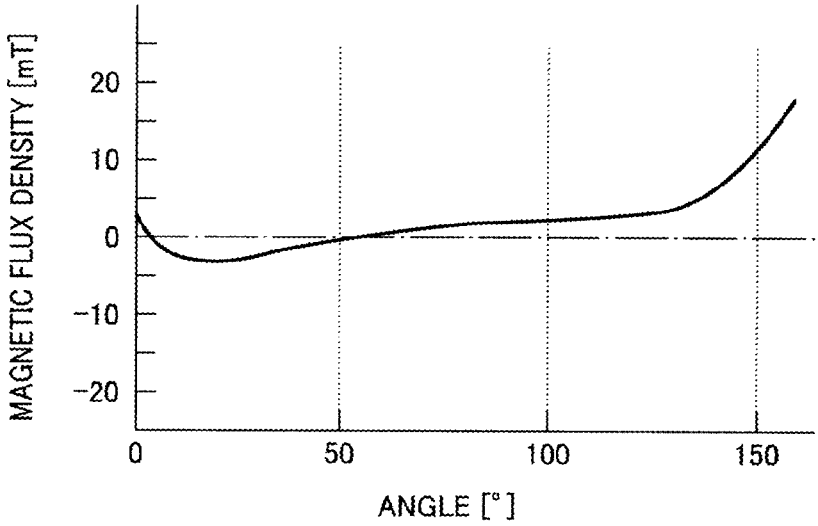
FIG. 8 is a graph of a relationship of position and magnetic flux density in the normal direction on the developing roller.
Figure 9:
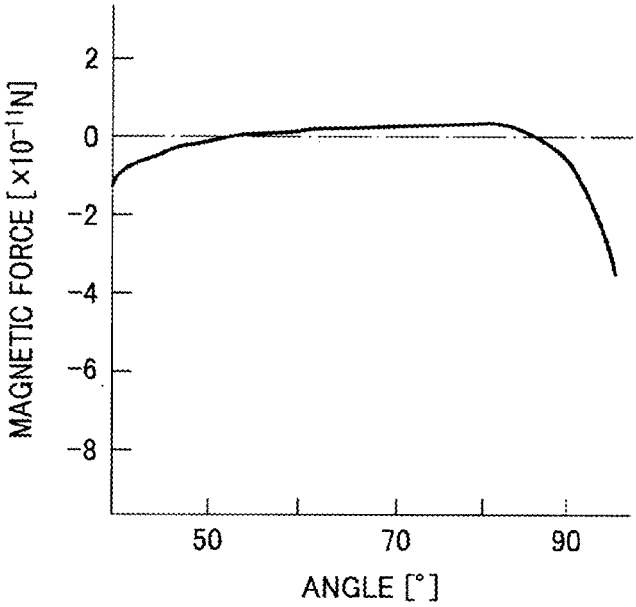
FIG. 9 is a graph of a magnetic force near a developer releasing magnetic pole shown in FIGS. 5, 6, and 7.

FIG. 7 is a polar graph of magnetic flux density in the normal direction to the developing roller 13*a*, and indicates the angle of the position on the developing roller 13*a* in the clockwise direction (the rotational direction) with a point near the boundary between the developer releasing magnetic pole H3 and the developer attracting magnetic pole H2 being the starting point (0 degree). FIG. 8 is a graph of the relationship of the position corresponding to the angle indicated in FIG. 7 and the magnetic flux density in the normal direction to the developing roller 13*a*, and is a cartesian graph of a part of the polar graph of FIG. 7 (range of 0 degrees to 150 degrees). FIG. 9 is the graph of a magnetic force near the developer releasing magnetic pole H3, and the angle along the horizontal axis corresponds to the angle (position on the developing roller 13*a*) in FIGS. 7 and 8. In FIG. 8, the positive direction of the magnetic flux density corresponds to an S-pole, and the negative direction corresponds to an N-pole. In FIG. 9, the positive side of the longitudinal axis (magnetic force) is the force in the direction of actively releasing the developer from the developing roller 13*a*.

The force attracting the developer G onto the developing roller 13*a* (sleeve 13*a*2) is a magnetic attraction force (magnetic force), and becomes positive in the normal direction to the developing roller 13*a*. That is, when the magnetic attraction force is negative, a force works on the developer G so that the developer G is attracted toward the developing roller 13*a*, and when the magnetic attraction force is positive, a force works on the developer G so as to release the developer G from the developing roller 13*a*. Therefore, the force that attracts the developer G to the developing roller 13*a* may be weakened to release the developer well from the developing roller 13*a*, and preferably the force may be formed in the positive direction (the direction repulsing against the developing roller 13*a*) at the position where the developer is released.

The magnetic attraction force ($F_r$: magnetic force) can be obtained with the following equation:

$$F_r=\mu_0 G(\mu_{se}^{-1})\cdot(H_r(\partial H_r/\partial r)+H_e(\partial H_e/\partial r))$$

where $H_r$ represents magnetic field in a radial direction (magnetic flux density in the normal direction to the developing roller 13*a*), $H_e$ represents magnetic field in a circumferential direction (magnetic flux density in a tangent line direction), $\mu_0$ represents vacuum permeability, G represents volume of the developer, r represents radius of the developing sleeve, and $\mu_{se}$ represents effective relative permeability of the developer.

Because the magnetic force is proportional to the product of the magnitude and the rate of change of the magnetic flux density, any one of a small magnitude and a small rate of change of the magnetic flux density or both becomes necessary to make the magnetic force (the magnetic attraction force) small.

Referring to FIG. 8, the magnetic flux density of the developer releasing magnetic pole H3 is formed to be equal to or less than 5 milliteslas in the present embodiment. The magnetic flux density is formed to be equal to or less than 5 milliteslas in the entire region including the downstream side position and also to the targeting position of releasing the developer (a region where the developer is necessarily released and it is in a range of about 0 to 90 degree). The magnetic flux density is formed so that its changing amount becomes less than 5 milliteslas in the region where the developer is necessarily released (0 to 90 degree). Therefore, a developer releasing region having a weak magnetic attraction force is formed where the developer can be released sufficiently.

In the present embodiment, a region is formed that not only has a small magnetic attraction force but also acts on the developer with respect to the developing roller 13*a*. Precisely, referring to FIG. 9, a region is formed so that the magnetic force becomes positive from near the position of angle 60 degree, and the developer is shot in the repulsing direction against the developing roller 13*a*. The magnetic force becomes negative from near the position of angle 85 degree. Referring to FIG. 8, this is because the magnetic flux density in the normal direction to the developing roller 13*a* is enhanced from near the position of angle 80 degree, and the attraction force to the developing roller 13*a* is strengthened.

It is necessary to reverse the magnetic flux density vector near the surface of the developing roller 13*a* to form the magnetic field repulsion against the developing roller 13*a*. Therefore, the polarity of the magnetic pole is reversed near the position of angle 50 degree as shown in FIG. 8. Specifically, the magnetic flux density vector is reversed by forming a small N-pole on the upstream side of the position of angle 50 degree, and the repulsive magnetic field as shown in FIG. 9 is formed.

A method is used of setting the magnetic flux density having counter polarity as described above by simulation after determining the arrangement of the magnetic pole, and of setting the waveform of the magnetic density by simulation to form a repulsive magnetic field as the method of designing the developing roller 13*a* having a repulsive magnetic field as described above. For example, to configure such magnetic field waveform with a block magnet, it may be considered that an excess magnetic field potential is not given near the position where the developer is released by arranging the magnet forming the magnetic field of the carrying magnetic pole H2 at a position near the surface of the sleeve.

The magnitude and the rate of change of the magnetic flux density of the developer releasing magnetic pole H3 is made to be equal to or less than 5 milliteslas in the present embodiment. However, because the developer releasability improves with a decrease in the magnitude and the rate of change of the magnetic flux density as described above, the magnitude and the rate of change of the magnetic flux density of the developer releasing magnetic pole H3 is more preferably set to be equal to or less than 1 millitesla.

The developer can be released more certainly when the region where the change of the magnetic flux density is small covers as broad a region in the rotational direction of the developing roller 13*a* as possible. Therefore, the magnitude and the rate of change of the magnetic flux density is preferably set to be equal to or less than 1 millitesla in a range exceeding the position of angle 60 degree for example.

In the present embodiment, referring to FIG. 5, the developer releasing magnetic pole H3 is arranged in the downstream side in the rotational direction of the developing roller 13*a* from a position where an imaginary line segment M connecting the rotational center of the developing roller 13*a* and the rotational center of the second carrying screw 13*b*2 intersects the outer peripheral surface of the developing roller 13*a*.

With such configuration, the developer G carried on the developing roller 13*a* is released after the developing step at the position of the developer releasing magnetic pole H3 along the tangent direction to the developing roller 13*a* and falls down right above of the second carrying route (the second carrying screw 13*b*2) (i.e., the developer G moves in the direction of the dashed line in FIG. 5). Therefore, the dispersibility of the supplying toner to the developer is improved because the released developer is mixed to fall down on the supplying toner which has a small specific gravity.

In the present embodiment, referring to FIG. 6, the carrying magnetic pole H2 acts on a part of the inner wall surface 13*d* of the second carrying route so that a part of the developer G in the second carrying route is pumped up on the developing roller 13*a*. The magnetic pole H1 is a magnetic pole between the magnetic poles H2 and H4 that sandwich the developer releasing magnetic pole H3, and that is located in the upstream side in the rotational direction of the developing roller 13*a* to the position of developer releasing magnetic pole H3.

With such configuration, the developer released at the position of the developer releasing magnetic pole H3 can be effectively stirred and mixed into the developer in the second carrying route even when the amount (the height) of the developer in the second carrying route becomes large in the downstream side of the second carrying route (FIG. 4 can be also referred to). That is, as shown by the bold line arrow in FIG. 6, the developer released at the position of the developer releasing magnetic pole H3 falls down to the upper section of the second carrying screw 13*b*2. Then, the developer is mixed into the developer after the developing step by moving along the rotation of the second carrying screw 13*b*2, stirring and mixing into the developer in the second carrying route, and then pumping up on the developing roller 13*a* by the carrying magnetic pole H2 acting on the inner wall surface 13*d*. By such circulation of the developer shown by the bold line arrow, the dispersibility of the released developer to the developer in the second carrying route is improved even when the amount of the developer in the second carrying route becomes large.

In the present embodiment, to make the above-described effect certain, the magnitude of the magnetic flux density in the normal direction to the developing roller 13*a* acting on the inner wall surface 13*d* near the developing roller 13*a* is set to be equal to or more than 70% of the maximum of the magnetic flux density in the normal direction of the carrying magnetic pole H2 so that a part of the developer G in the second carrying route can be pumped up on the developing roller 13*a*. Specifically, the magnetic flux density, that is the magnetic flux density in the normal direction to the developing roller 13*a*, of the carrying magnetic pole H2 acting on the inner wall surface 13*d* of the second carrying route is set to be equal to or more than 50 milliteslas.

As explained above, in the present embodiment, two carrying screws 13*b*1 and 13*b*2 (carrying members) that form the developer circulation route by longitudinally carrying the developer G are arranged one above the other in vertical direction. Two magnetic poles H2 and H4 sandwiching the developer releasing magnetic pole H3 have the same polarity, and the developer releasing magnetic pole H3 is formed by two magnetic poles H2 and H4 with a different magnetic pole from the polarity of two magnetic poles H2 and H4. With this configuration, the developer releasing magnetic pole H3 having a very small magnetic flux density in the normal direction to the developing roller 13*a* is formed in a relatively wide area on the developing roller 13*a* (a developer carrier). Therefore, the developer G carried on the developing roller 13*a* after the developing step is certainly released in the second carrying route, and image concentration deviation hardly occurs on the output image.

In the present embodiment, the toner T is supplied from the toner container 28 to the developing device 13. However, the developer G (the toner T and the carrier C) can be also supplied from the toner container (a developer container) to the developing device 13. In that case, a means for discharging appropriate amount of the developer from the developing device 13 can be provided. Even in such case, the same effect with the present embodiment can be obtained.

The present embodiment is applied to an image forming apparatus in which the developing device 13 is configured as a single unit that can be attached or removed from the image forming apparatus main body 1. However, the application of the present embodiment is not limited to this, and the present embodiment can be off course applied to an image forming apparatus in which a part or the entire of the image forming unit is made into a process cartridge.

The present embodiment is applied to the developing device 13 in which two carrying screws are arranged as the carrying members. However, the present embodiment can be also applied to a developing device in which three or more carrying screws are arranged and at least two of three screws are arranged one above the other in vertical direction. The present embodiment is applied to the developing device 13 in which one developing roller 13*a* is arranged. However, the present embodiment can also be applied to a developing device in which a plurality of developing rollers 13*a* is arranged vertically. In the present embodiment, the number of the magnetic poles H1 to H4 formed around the developing roller 13*a* is made to be four. However, the number of the magnetic poles formed around the developing roller 13*a* can be made to be between three and five.

The same effect as the present embodiment can be obtained in those cases by forming the developer releasing magnetic pole by two magnetic poles so that the polarity of the developer releasing magnetic pole of the developing roller differs from the polarity of the two magnetic poles sandwiching it.

The present invention can provide a developing device, a process cartridge, and an image forming apparatus in which the developer carried on the developer carrier in the second carrying route after the developing step is certainly released because the developer releasing magnetic pole is formed by two magnetic poles so that polarity of the developer releasing magnetic pole H3 differs from two magnetic poles having the same polarity sandwiching the developer releasing magnetic pole when at least two carrying members among carrying members forming the circulating route by longitudinally carrying the developer vertically arranged.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device that develops an electrostatic latent image on an image carrier by using a developer that contains a carrier and a toner, the developing device comprising:

a developer carrier arranged so as to face the image carrier, a plurality of magnetic poles being formed on circumferential direction of the developer carrier; and a plurality of carrying members that form a developer circulation route by longitudinally carrying the developer inside a cavity in the developing device, the carrying members including a first carrying member that supplies the developer in the cavity to the developer carrier at a position of a first magnetic pole among the magnetic poles while longitudinally carrying the developer, the first magnetic pole being a developer attracting magnetic pole; and a second carrying member that longitudinally carries a developer released from the developer carrier at a position of a second magnetic pole among the magnetic poles, the second magnetic pole being generated at a position where the developer is released, wherein the developer carrier is formed such that two magnetic poles sandwiching the second magnetic pole have a same polarity and the second magnetic pole is formed by the two magnetic poles so that the polarity of the second magnetic pole differs from the polarity of the two magnetic poles, wherein the peak position of a magnetic flux density in a normal direction for each of the two magnetic poles are separated from each other by an angle of more than 180°, and wherein the second magnetic pole is inside an area within the angle of more than 180°.

2. The developing device according to claim 1, wherein a magnetic flux density of the second magnetic pole is to be equal to or less than 5 milliteslas.

3. The developing device according to claim 1, wherein the second magnetic pole is arranged at a downstream side in a rotational direction of the developer carrier to a position where an imaginary line segment connecting a rotational center of the developer carrier and a rotational center of the second carrying member intersects a circumferential surface of the developer carrier.

4. The developing device according to claim 1, further comprising:

a relay unit that supplies the developer that reaches a downstream side of a developer carrying route of the first carrying member to a downstream side of a developer carrying route of the second carrying member; and a toner supplying port that supplies new toner in the developing device and arranged near the relay unit.

5. The developing device according to claim 1, wherein a rotational direction of the second carrying member is same as a rotational direction of the developer carrier, and a part of the developer in a developer carrying route is returned to the developer carrier by a magnetic pole arranged at a downstream side in the rotational direction of the developer carrier to the second magnetic pole between the two magnetic poles acting on a part of an inner wall surface of the developer carrying route of the second carrying member.

6. The developing device according to claim 5, wherein the magnetic flux density of the magnetic pole acting on a part of the inner wall surface of the developer carrying route of the second carrying member is equal to or more than 50 milliteslas.

7. The developing device according to claim 1, wherein the second magnetic pole is a developer releasing magnetic pole.

8. A process cartridge that can be attached or removed from a body of an image forming apparatus, the process cartridge comprising a developing device and an image carrier integrated as one unit, the developing device being the developing device according to claim 1.

9. The process cartridge according to claim 8, wherein the second magnetic pole is a developer releasing magnetic pole.

10. An image forming apparatus comprising a developing device and an image carrier, the developing device being the developing device according to claim 1.

11. The image forming apparatus according to claim 10, wherein the second magnetic pole is a developer releasing magnetic pole.

12. A method of developing to be implemented in a developing device that develops an electrostatic latent image on an image carrier by using a developer that contains a carrier and a toner, the developing device including a developer carrier arranged so as to face the image carrier, a plurality of magnetic poles being formed on circumferential direction of the developer carrier; and a plurality of carrying members that form a developer circulation route by longitudinally carrying the developer inside a cavity in the developing device, the carrying members including a first carrying member that supplies the developer in the cavity to the developer carrier at a position of a first magnetic pole among the magnetic poles while longitudinally carrying the developer, the first magnetic pole being a developer attracting magnetic pole; and a second carrying member that longitudinally carries a developer released from the developer carrier at a position of a second magnetic pole among the magnetic poles, the second magnetic pole being generated at a position where the developer is released, the method comprising:

forming two magnetic poles sandwiching the second magnetic pole on the developer carrier such that the two magnetic poles have a same polarity; and forming the second magnetic pole on the developer carrier by the two magnetic poles so that the polarity of the second magnetic pole differs from the polarity of the two magnetic poles, the peak position of a magnetic flux density in a normal direction for each of the two magnetic poles being separated from each other by an angle of more than 180°, and the second magnetic pole being inside an area within the angle of more than 180°.

13. The method according to claim 12, wherein the second magnetic pole is a developer releasing magnetic pole.

* * * * *